US007357286B2

(12) United States Patent
Kubo et al.

(10) Patent No.: US 7,357,286 B2
(45) Date of Patent: Apr. 15, 2008

(54) NAILING MACHINE

(75) Inventors: Kouji Kubo, Tokyo (JP); Yasunori Aihara, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/548,186

(22) PCT Filed: Apr. 21, 2004

(86) PCT No.: PCT/JP2004/005697

§ 371 (c)(1),
(2), (4) Date: Jun. 6, 2006

(87) PCT Pub. No.: WO2004/098837

PCT Pub. Date: Nov. 18, 2004

(65) Prior Publication Data

US 2006/0255088 A1 Nov. 16, 2006

(30) Foreign Application Priority Data

May 9, 2003 (JP) ..... 2003-131043

(51) Int. Cl.
*B25C 1/04* (2006.01)

(52) U.S. Cl. ..... 227/119; 227/8; 227/120; 227/136

(58) Field of Classification Search ..... 227/119, 227/120, 8, 136, 130
See application file for complete search history.

(56) References Cited

U.S. PATENT DOCUMENTS 3,260,437 A * 7/1966 Parr ..... 227/149
4,253,598 A * 3/1981 Haytayan ..... 227/119
4,549,682 A * 10/1985 Hebert ..... 227/119
4,832,245 A * 5/1989 Terayama et al. ..... 227/130
5,238,167 A 8/1993 Howard et al.
5,452,835 A * 9/1995 Shkolnikov ..... 227/8
5,647,525 A * 7/1997 Ishizawa ..... 227/113
6,003,751 A * 12/1999 Ohmae ..... 227/130
6,279,808 B1 * 8/2001 Larsen ..... 227/119
6,431,428 B1 * 8/2002 Chen ..... 227/120
6,578,749 B1 * 6/2003 Shen et al. ..... 227/119
6,622,901 B2 * 9/2003 Hamano et al. ..... 227/119
6,695,196 B2 * 2/2004 Hamada et al. ..... 227/119
6,808,101 B2 * 10/2004 Laubach et al. ..... 227/109

FOREIGN PATENT DOCUMENTS

| | | |
|---|---|---|
| EP | 1 258 323 A2 | 11/2002 |
| JP | 51-51577 | 4/1976 |
| JP | 55-157484 | 12/1980 |
| JP | 7-208869 | 11/1995 |
| JP | 7-308869 | 11/1995 |
| JP | 2002-337066 | 11/2002 |

* cited by examiner

*Primary Examiner*—Scott A. Smith
(74) *Attorney, Agent, or Firm*—Morgan, Lewis & Bockius LLP

(57) ABSTRACT

A contact nose 15, in which an ejection opening 24 is formed coaxially with an ejection opening 18 of a nose portion 13 that guides a driver slidably, is slidably provided at an end part of the nose portion 13 to be urged in a direction of an end portion of the ejection opening 18. A guide slope 28 adapted to guide a tip end of a nail, which is hammered out tiltingly from the ejection opening 18 of the nose portion 13, into the ejection opening 24 is formed on an upper rear side of the ejection opening 24 of the contact nose 15.

9 Claims, 6 Drawing Sheets

NAILING MACHINE

TECHNICAL FIELD

The present invention relates to a nailing machine in which a nail supplied into an ejection opening is hammered into a member to be nailed, by using a driver impactively driven by the power of compressed air or the like. More particularly, the present invention relates to a nail hammering guide mechanism in the nailing machine for guiding a nail hammered out of the ejection opening by the driver toward the member to be nailed.

BACKGROUND ART

A conventional nailing machine using compressed air as a power source is adapted so that a hammering piston is slidably accommodated in a hammering cylinder disposed in a housing, that the hammering piston is driven by supplying compressed air into the hammering cylinder, and that a nail supplied into an ejection opening in a nose portion is hammered out therefrom by a driver integrally mounted on the hammering piston toward a member to be nailed. The nose portion, in which the ejection opening for slidably guiding the driver is formed, is connected to a lower portion of the housing. An aperture opened toward a rear side of the nose portion so as to supply a nail into the ejection opening is formed in the nose portion. Connected nails accommodated in a magazine are supplied into the ejection opening by a nail supply mechanism through the aperture.

Also, a main valve is provided at the top end of the hammering cylinder. The opening/closing operations of the main valve are performed by using a trigger valve that is operated by a manually operatable trigger lever. Thus, compressed air is introduced into the hammering cylinder to thereby drive the hammering piston. A contact member, which is projected frontwardly from the ejection opening and is operated in contact with the member to be nailed, is disposed at an end part of the nose portion in which the ejection opening is formed. The trigger valve is activated on the condition that this contact member is operated in contact with the member to be nailed, and that the trigger lever disposed at a base part of a grip portion is manually operated. Thus, a safety mechanism enabled to prevent the trigger valve from being unexpectedly activated is constituted. Further, the end part of the nose portion, in which the ejection opening is formed, is divided thereby to form a separate nose top member. The contact member is constituted as a contact nose portion serving also as the nose top member. Thus, even in a case where the housing of the nailing machine and the nose portion are upwardly moved due to a reaction phenomenon caused when a nail is hammered, the contact nose portion maintains contact with the member to be nailed. Thus, a driver mark phenomenon, that the driver scratches the member to be nailed due to the misalignment between the driver and the head of a nail, is prevented (see, for example, JP-A-2002-337066).

Meanwhile, when a foremost one of the connected nails, which are connected together and supplied into the ejection opening, is hammered out therefrom by the driver, the following phenomenon occurs. That is, the foremost nail is hammered out therefrom so that a tip end portion of the foremost nail leans to the rear side thereof due to resistance caused at the disconnection between the foremost nail and the subsequent nail. To prevent a nail, which leans in this manner, from being hammered out to the rear side, the conventional nailing machine is configured so that a guide slope, which contacts with a tip end portion of the nail so as to guide the tip end portion of the nail toward the inside of the ejection opening, is formed at a bottom edge portion of the opening, and that the contact nose portion is placed at a lower part of the guide slope so as to prevent the contact nose portion from interfering with the guide slope of the nose portion.

The placement of the contact nose portion at the lower part of the guide slope of the nose portion in the aforementioned nailing machine results in that an end portion of the ejection opening formed in the contact nose portion is downwardly disposed. This requires an increase of the length of the driver hammering the nail for that. In a case where the driver is formed by being extended downwardly, the bottom position of the driver, which corresponds to the top dead center of the hammering piston, is downwardly shifted. Thus, it is necessary to upwardly shift the position of the top dead center of the piston. Consequently, the conventional nailing machine has drawbacks in that the placement of the nose top member downwardly from the guide slope of the nose portion results in large overall height and weight of the mailing machine adapted to hammer a nail having the same length, and that such an ill-balanced nailing machine impairs the workability thereof.

Further, the length of the nose to the end thereof is set according to that of nails to be used. In a case where a nail pickup slope is formed at the bottom of the nose portion, a component used as the nose portion, whose length is set according to the length of a nail to be used, should be formed as a component inherent in the machine. Consequently, the conventional nailing machine has another drawback in that the manufacturing cost thereof is increased.

DISCLOSURE OF THE INVENTION

Problems to be solved by the invention are to eliminate the drawbacks of the conventional nailing machine, and to provide a nailing machine that is enabled to improve the finishing performance thereof against a reaction of the nailing machine, and also enabled to be formed to have a small overall height and that has a nail hammering guide mechanism of good workability.

To solve the foregoing problems, according to the invention, there is provided a nail hammering guide mechanism for use in a nailing machine, which has a driver driven by an impact mechanism formed in a housing, a nose portion having an ejection opening, which guides the driver slidably, and an aperture formed to be opened to a rear side of the ejection opening, and a nail supply guide formed continuously to and integrally with a side edge of the aperture, and a nail supply mechanism configured to reciprocatively move along the nail supply guide and to supply a foremost one of nails connected together from the aperture into the ejection opening. A nail supplied into the ejection opening is hammered out from the ejection opening by the driver. This nailing machine features that a contact nose having an ejection opening formed therein coaxially with the ejection opening of the nose portion is slidably provided at an end part of the nose portion to be urged in a direction of an end portion of the ejection opening of the nose portion, having an ejection opening formed coaxially with the ejection opening, and that a guide slope adapted to guide a tip end of a nail, which is hammered out tiltingly from the ejection opening of the nose portion to a rear side thereof, is formed at an upper rear side of the ejection opening of the nose portion.

Also, an embodiment of the nail hammering guide mechanism features that the bottom portion of the nail supply mechanism is formed to be extended downwardly, and that the bottom portion regulates a tilt angle of a nail to prevent an axis of a nail supplied into the ejection opening of the nose portion from being inclined rearward toward the guide slope.

Figure 1:
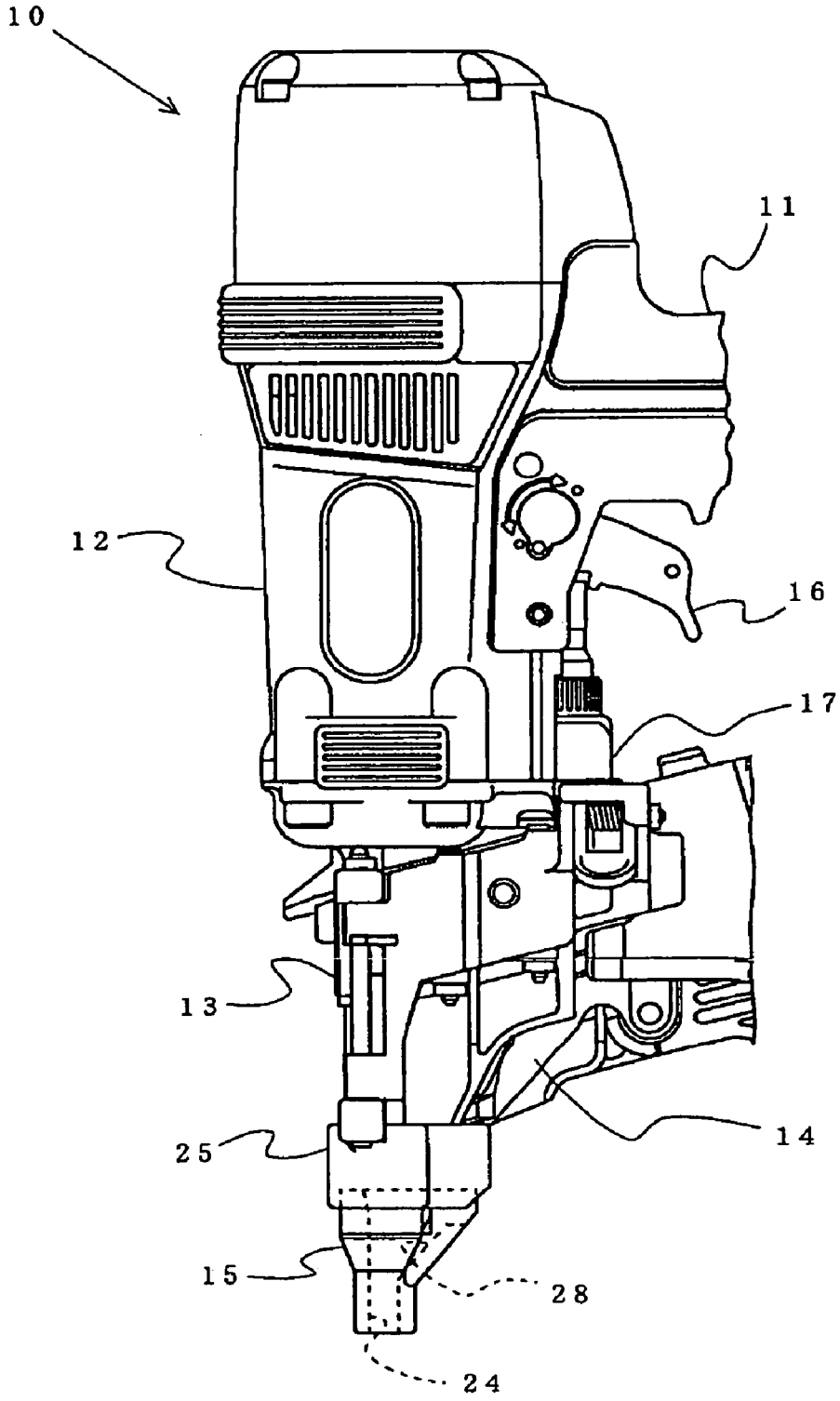
FIG. 1 is a side view illustrating a part of a nailing machine according to an embodiment of the invention.

Incidentally, in the figures, reference numeral 10 denotes a nailing machine. Reference numeral 13 denotes a nose portion. Reference numeral 14 denotes a nail supply guide. Reference numeral 15 denotes a contact nose. Reference numeral 18 denotes an ejection opening. Reference numeral 21 denotes a nail feeding claw. Reference numeral 21*a* denotes a bottom portion. Reference numeral 22 denotes a nail supply mechanism. Reference numeral 23 denotes a driver. Reference numeral 24 denotes an ejection opening. Reference numeral 25 denotes a nose holder. Reference numeral 27 denotes a side wall. Reference numeral 28 denotes a guide slope.

BEST MODE FOR CARRYING OUT THE INVENTION

Hereinafter, a mode for carrying out the invention is described according to an embodiment shown in the accompanying drawings. FIG. 1 shows a part of a nailing machine according to the embodiment of the invention. The nailing machine 10 has a hollow housing 12 formed integrally with a grip portion 11. An impact mechanism, which includes a hammering cylinder and a hammering piston slidably accommodated in this hammering cylinder, is formed in the housing 12. The hammering piston is driven by supplying compressed air into the hammering cylinder to thereby drive the driver integrally connected to the bottom surface side of the hammering piston.

A nose portion 13, in which a hollow ejection opening adapted to slidably guide the driver integrally connected to the hammering piston is formed, is attached to a lower part of the housing 12. A nail supplied into the ejection opening of the nose portion 13 is hammered out from the ejection opening by the driver. An aperture, through which a nail is supplied into the ejection opening, is formed at a rear side of the ejection opening formed in the nose portion. A nail supply guide 14 extends continuously toward a rear side of and is formed integrally with one side edge of this aperture. A nail supplied along this nail supply guide 14 can be supplied into the ejection opening through the aperture.

Nails used in this nailing machine are formed as connected-nails that are connected together by connecting the shanks of nails with a connecting-element, such as a metal wire or a plastic belt. A nail supply mechanism adapted to be reciprocatively driven along the nail supply guide surface is formed on the guide surface of the nail supply guide 14. This nail supply mechanism contacts with the rear side of the shank of the foremost one of the connected nails guided along the nail supply guide. The nail supply mechanism is driven in the direction of the ejection opening to thereby supply the foremost one of the connected nails into the ejection opening. Then, the supplied nail is hammered out from the ejection opening by the driver.

Figure 2:
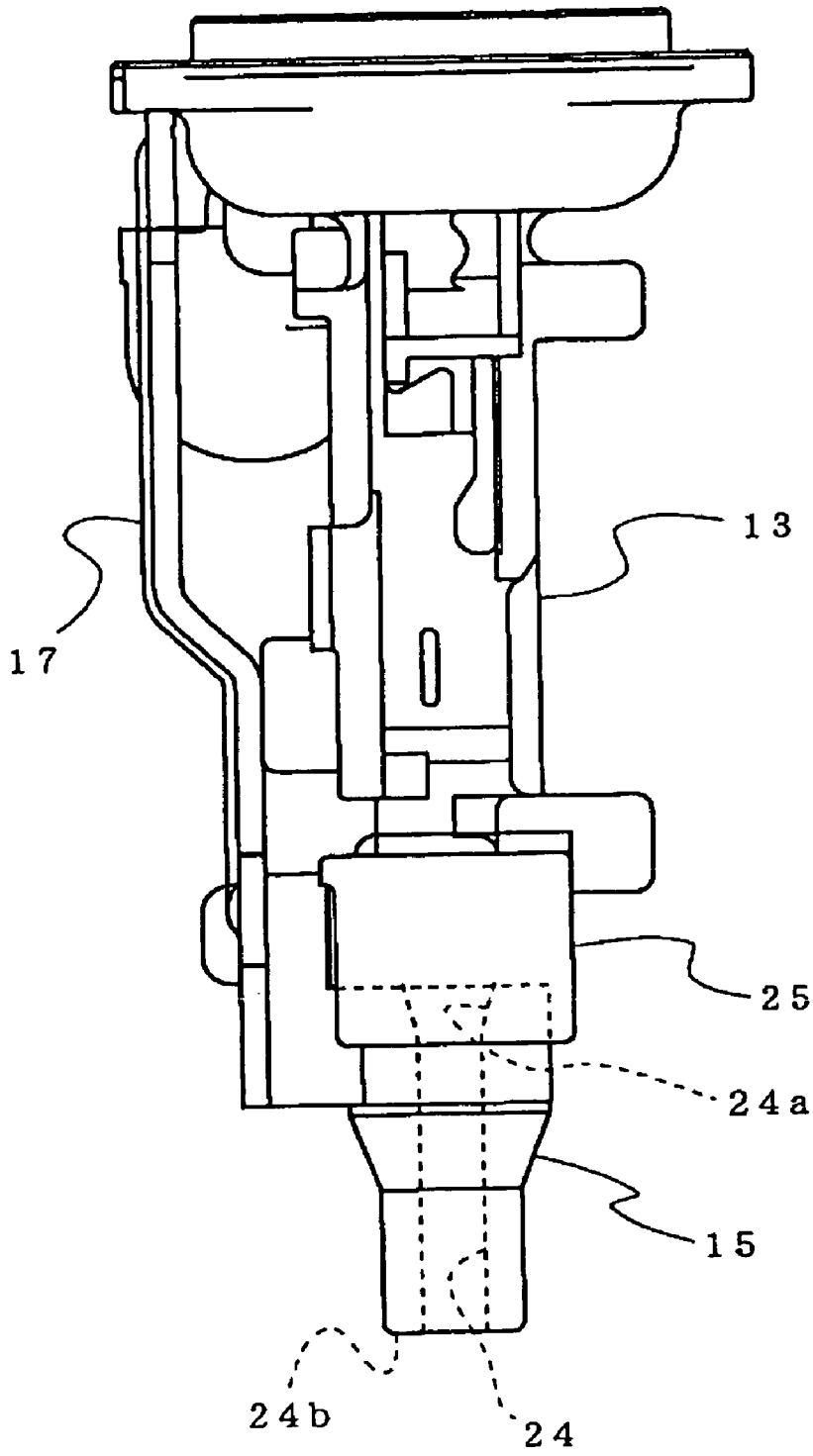
FIG. 2 is a front view of a part of the nailing machine shown in FIG. 1.

A contact nose 15 supported at an end part of the nose portion 13 slidably along the nose portion 13. As shown in FIG. 2, this contact nose 15 is connected to the bottom of a contact arm 17, whose top is disposed in the vicinity of a trigger lever 16, which activates the nailing machine 10, and is urged to protrude in a direction of the end of the nose portion 13. The contact nose 15 is upwardly moved with respect to the nose portion 13 by pushing the nailing machine 10 against the member to be nailed. Resultantly, the contact arm 17 is upwardly moved, so that the top portion of the contact arm 17 and the trigger lever 16 cooperate to activate the nailing machine 10.

Figure 3:
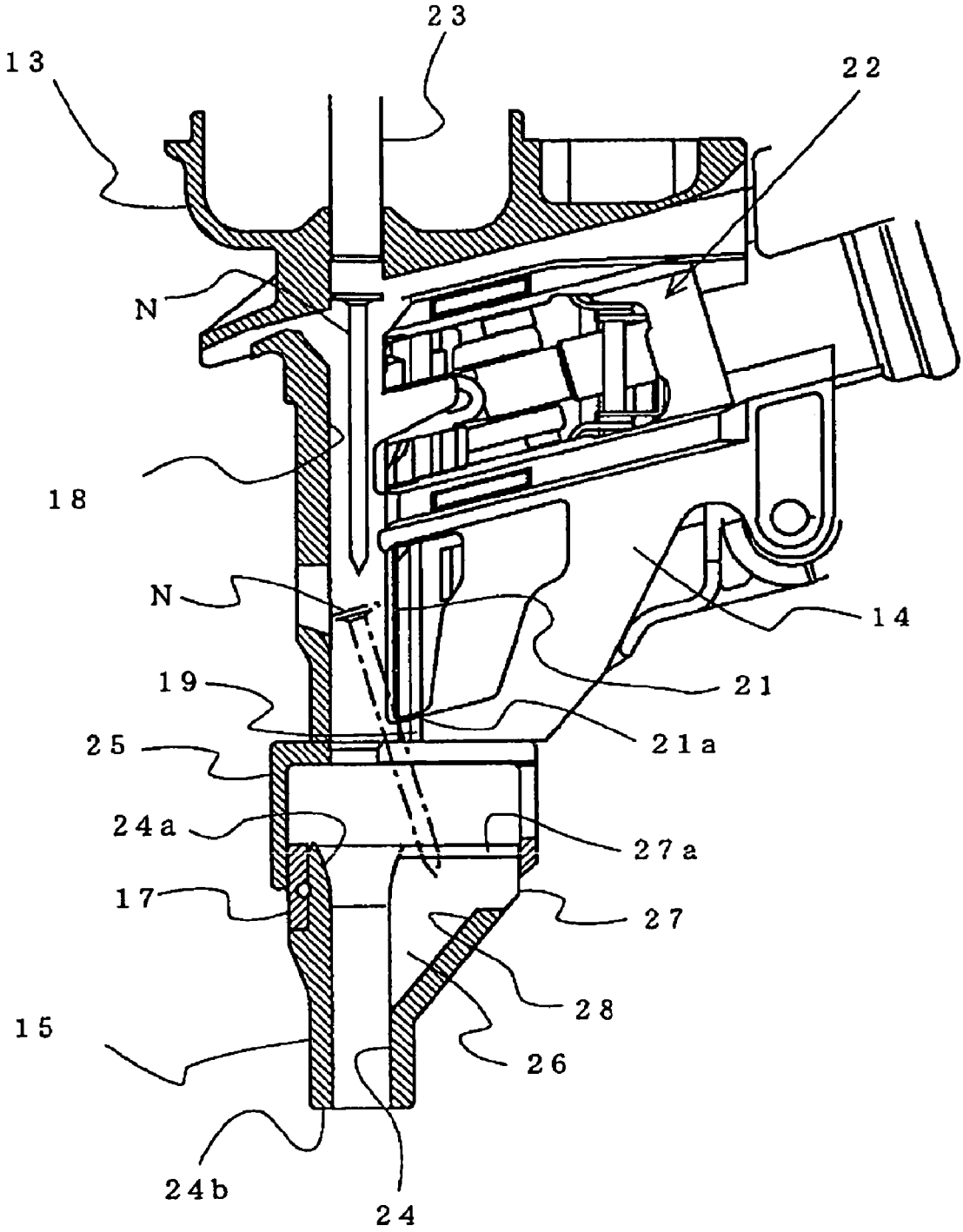
FIG. 3 is a longitudinally cross-sectional side view of the nailing machine shown in FIG. 2.

As shown in FIG. 3 in detail, an aperture 19, through which the foremost one of the connected nails is introduced into the ejection opening 18, is formed in the rear of the election opening 18 formed in the nose portion 13. The nail supply guide 14 extends continuously posterior to and is formed integrally with one of edges of this aperture 19. A magazine (not shown), which accommodates the connected nails, is provided continuously to the rear end portion of this nail supply guide 14. One of the connected nails, which is drawn out of the magazine, is guided along the nail supply guide 14 and is supplied into the ejection opening 18 of the nose portion 13 from the aperture 19. The guide surface of the nail supply guide 14 is provided with a nail feeding claw 21 contacting with the one of the connected nails. Also, the nail supply mechanism 22 reciprocatively driven along a direction, in which a nail is supplied, is formed on the guide surface of the nail supply guide 14. The nail feeding claw of the nail supply mechanism 22 contacts with the rear side surface of the shank of the foremost one of the connected nails and supplies the foremost nail into the ejection opening 18.

Before the nailing machine 10 is activated, the driver 23 connected to the hammering piston is on standby above the nail, which is supplied by the nail supply mechanism 22 into the ejection opening 18. When the nailing machine 10 is activated, the driver 23 is impactively operated in the ejection opening 18 and hammers out the nail, which is supplied into the ejection opening 18, from the ejection opening 18. The nail feeding claw 21 of the nail supply mechanism 22 is disposed to block, when the nail is hammered out by the driver 23 from the ejection opening 18, a part of the aperture 19 so as to prevent the nail, which is hammered out by the driver 23, from projecting rearwardly from the aperture 19.

The contact nose 15, in which an ejection opening 24 is formed coaxially with the ejection opening 18 of the nose portion 13, is held slidably along the direction, in which the nail is hammered out, by a nose holder 25 attached to the bottom part of the nose portion 13. The contact nose 15 is connected to the bottom of the contact arm 17, whose top is disposed in the vicinity of the trigger lever 16. The contact nose 15 is pushed by downwardly pushing this contact arm 17 to protrude in a direction in which the nail is hammered out. When the nailing machine 10 is pressed against the member to be nailed, the contact nose 15 is upwardly moved with respect to the nose portion 13. Consequently, the contact arm 17 is upwardly operated. The nailing machine is activated by operating both the contact nose 15 and the trigger lever 16.

The ejection opening 24 formed in the contact nose 15 is formed to have an inside diameter substantially equal to that of the ejection opening 18 of the nose portion 13 so that the ejection opening 24 can accommodate both a nail, which is hammered out from the ejection opening 18 of the nose portion 13, and the driver 23. The ejection opening 24 is disposed by being aligned with the ejection opening 18 of the nose portion 13. A tapered blowpipe-like portion 24*a*, which guides the head of the nail hammered out from the nose portion 13 into the ejection opening 24 and has an enlarged inside-diameter, is formed at the top portion of the ejection opening 24. The bottom portion of the ejection opening 24 constitutes an ejection opening end portion 24*b* whose entire circumference is closed by an annular peripheral wall. Thus, the head portion of the hammered nail can surely be guided. Consequently, the driver mark phenomenon that the driver 23 scratched the member to be nailed due to the misalignment between the driver 23 and the head of the nail, can be effectively prevented.

Figure 4:
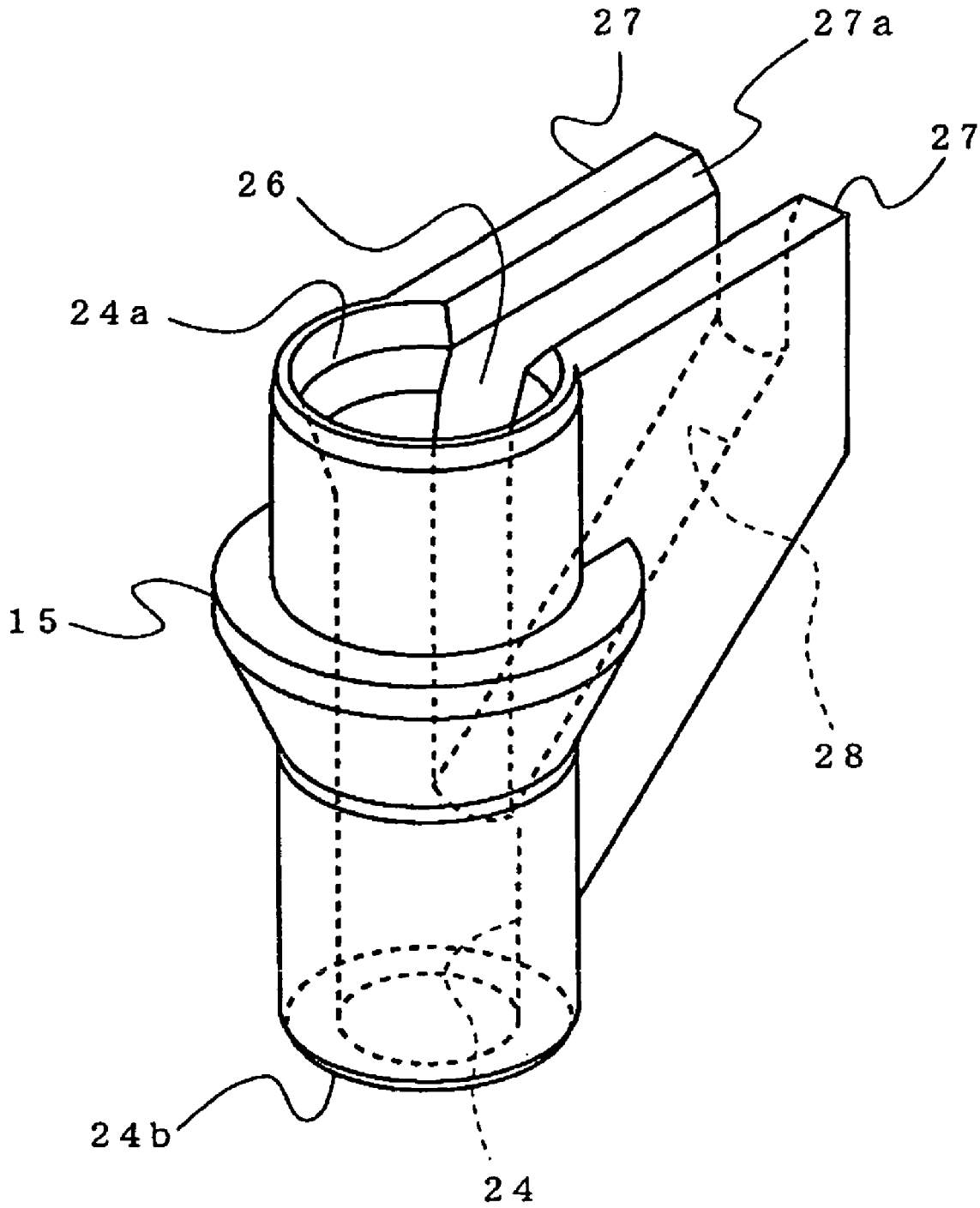
FIG. 4 is a perspective view of a contact nose constituting a nail hammering guide mechanism.

As shown in FIG. 4, an aperture 26 is formed in the contact nose 15 by opening an upper portion of the ejection opening 24, which is formed in this contact nose 15, toward the rear side. Side walls 27 respectively continued to both side edges of this aperture 26 are formed integrally with the contact nose 15 to extend rearwardly. A guide slope 28, which is downwardly inclined and extends from the rear end of each of both the side walls 27 to the ejection opening 24, is formed between the bottom portions of both the side walls 27. The tip end portion of the nail hammered out rearwardly tiltingly from the aperture 19 of the ejection opening 18 of the nose portion 13 is guided by this guide slope 28 into the ejection opening 24. Also, a slope 27 *a* is formed on the inner top edge of each of both side walls 27 and guides the tip end of a nail, which is hammered out from the ejection opening 18 of the nose portion 13, between both the side walls 27 and causes the tip end of the nail to contacts with the guide slope 28.

The nail feeding claw 21 adapted to supply a nail into the ejection opening 18 of the nose portion 13 is disposed to block a part of the aperture 19 of the nose portion 13 and regulates the nail, which is hammered out by the driver 23 in the ejection opening 18 of the nose portion 13, from being inclined to the rear of the ejection opening 18. However, the bottom portion 21*a* of the nail feeding claw 21 contacting with the shank of the hammered nail is formed by being downwardly extended so that when a nail N having a short shank is hammered, a prolonged line of the shank of this inclined nail intersects with the guide slope 28 of the contact nose 15, as indicated by dot-dash-lines in FIG. 3. Thus, an angle of inclination of a nail is regulated.

Figure 5:
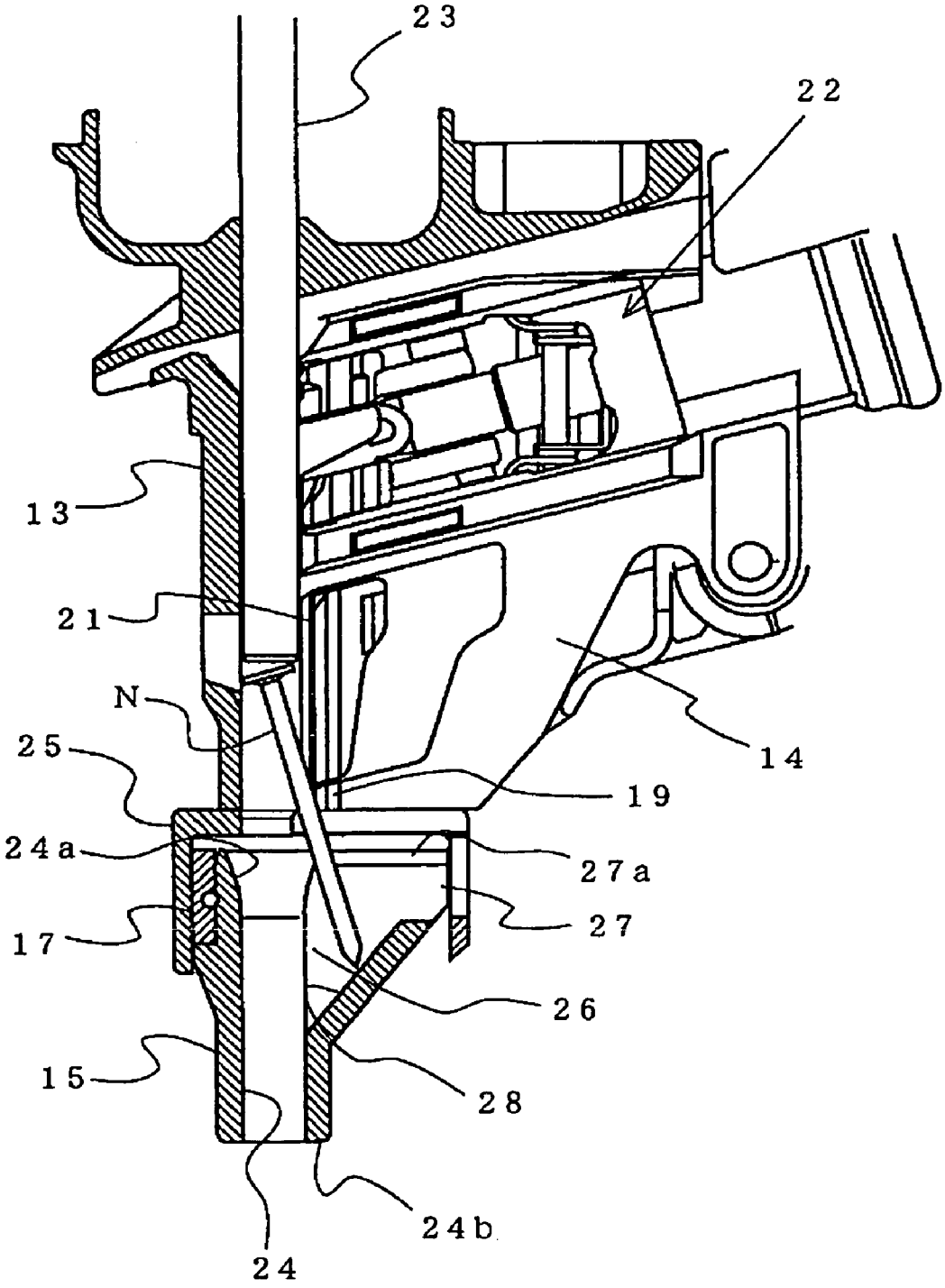
FIG. 5 is a longitudinally cross-sectional side view illustrating a state in which a nailing operation is performed, similarly to FIG. 3.

The contact nose 15, on which the guide slope 28 for contacting with the nail hammered out rearwardly tiltingly from the ejection opening 18 is formed, is normally disposed to project in a direction of the end of the nose portion 13. However, as illustrated in FIG. 5, when a nail is normally hammered, the contact nose 15 contacts with the member to be nailed and is upwardly moved. Consequently, the contact arm 17 is upwardly moved to thereby activate the nailing machine 10. The driver 23 driven by the hammering piston hammers the nail N placed in the ejection opening 18. Thus, the hammering of the nail is performed. The nail hammered out by the driver 23 in the ejection opening 18 of the nose portion 13 is put into a state in which the tip end portion of the nail is inclined rearwardly by resistance caused at disconnection from the other connected nails and is projected from the aperture 19. Then, the nail contacts with the guide slope 18 of the contact nose 15 and is guided into the ejection opening 24 of the contact nose 15. Subsequently, the nail is hammered into the member, which is to be nailed, in a substantially vertical position from the ejection opening 24 of the contact nose 15.

Figure 6:
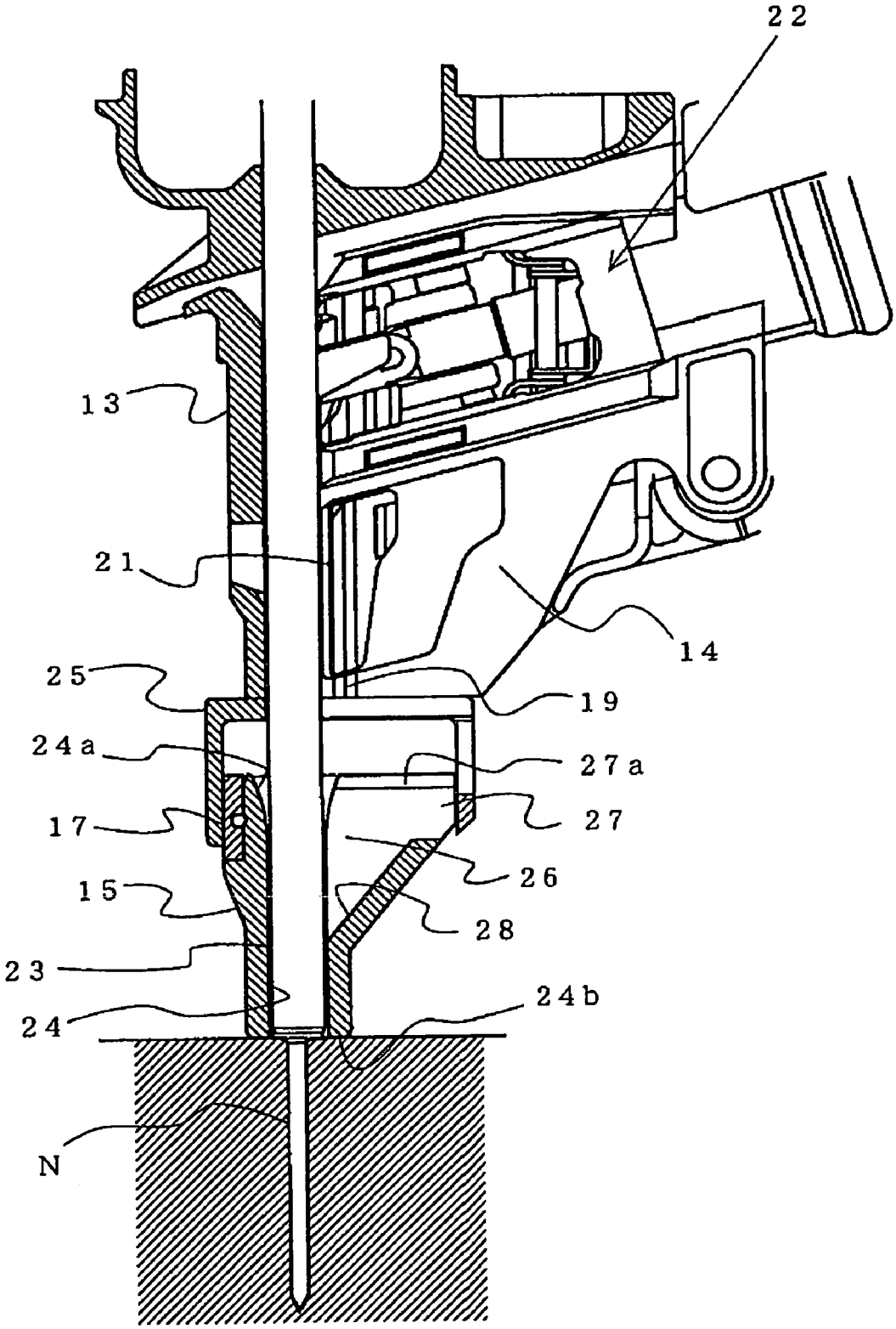
FIG. 6 is a longitudinally cross-sectional side view illustrating a state in which a nose portion is upwardly moved by a reaction of the machine, similarly to FIG. 3.

When the hammering piston, to which the driver hammering a nail is connected, is driven by compressed air, a phenomenon, in which the housing 12 of the nailing machine 10 upwardly leaps, occurs as a reaction. Consequently, even when the nose portion 13 is upwardly moved, the contact nose 15 is supported slidably with respect to the nose portion 13 and is urged to project in the direction of the end thereof, as shown in FIG. 6. Thus, the ejection opening end portion 24*b* of the ejection opening 24 formed in the contact nose 15 abuts against the surface of the member to be nailed. The driver 23 adapted to hammer a nail is prevented from being misaligned with the head portion of the nail and from damaging the member to be nailed. Consequently, an interior finish operation can easily be achieved.

As described above, at a normal nail hammering operation, a nail is hammered out in a state in which the contact nose 14 is upwardly moved and in which the guide slope 28 is placed at an upper position. Thus, the guide slope 28 is disposed at a place at which the guide slope 28 can guide the tip end of the nail. For example, in the case of an operation of hammering nails in a contact-nose knocking mode in which nails are consecutively hammered at a high speed by activating the nailing machine 10 each time when the member to be nailed is knocked with the contact nose 15 while the trigger lever 16 is depressed, nails are sometimes hammered out when the contact nose are disposed at a lower place. In such a case, when the bottom portion of the nail feeding claw 21 remains at a normal position, the angle of inclination of the nail N in the ejection opening 18 of the nose portion 13 increases. Sometimes, the nail N is disengaged from the guide slope 28 and is hammered out rearwardly therefrom. However, as described above, the bottom portion 21*a* of the nail feeding claw 21 contacts with the shank of the nail N by being downwardly extended to thereby regulate the inclination of the nail from increasing. Thus, even when a nail is hammered out in a state in which the contact nose 15 is disposed at a lower place and in which the guide slope 28 is placed at a lower place, the nail can be surely prevented from being hammered out rearwardly.

INDUSTRIAL APPLICABILITY

As described above, according to the invention, the contact nose, in which the ejection opening is formed coaxially with the ejection opening of the nose portion that guides the driver slidably, is provided at an end part of the nose portion slidably along a direction, in which a nail is hammered out, and urged in the direction of the end portion of the ejection opening. Thus, even when the nailing machine is upwardly moved by a reaction or the like, the end portion of the ejection opening is in intimate contact with the member to be nailed. Consequently, an occurrence of misalignment between the driver and the member to be nailed can be prevented. A nail can be hammered into the member, without marking the member by the driver, to be flush therewith.

Also, the guide slope adapted to guide a tip end of a nail, which is hammered out rearwardly tiltingly from the ejection opening of the nose portion, is formed at the upper rear side of the ejection opening of the nose portion. Thus, there is no need for forming a guide slope on the nose portion. The contact nose can be disposed at an upper position. Consequently, it is unnecessary to form the driver to have a large length. Also, it is unnecessary to set the stroke of the hammering piston at a large value. Thus, the nailing machine can be configured to have a small overall height. The reduction in size and weight of the nailing machine can be achieved. Consequently, the workability in nailing can be enhanced.

Further, in the conventional nailing machine, the guide slope is formed at the bottom of the nose portion. Thus, it is necessary to form the nose portion as an inherent component whose length to the guide slope provided at the bottom thereof varies with the length of a nail to be used. Consequently, the manufacturing cost of the machine is increased. However, according to the invention, the guide slope is formed at the contact nose, so that it is sufficient to adjust the length of the bottom part of the nose portion according to the length of a nail to be used. Thus, the nose portions for use in the nailing machine, which correspond to nails respectively having various lengths, are manufactured by using a common material. Then, the bottom parts of the nose portions made of the common material are cut according to the lengths of nails to be used in the nailing machines. Consequently, the manufactured nose portions can be used in common by the machines. This enables reduction in the manufacturing cost of the nailing machines.

Additionally, the nail supply mechanism is formed so that the bottom portion of the nail supply mechanism is downwardly extended to a position at which a tilt angle of a nail is regulated so as to prevent an axially prolonged line extending in a direction of a tip end of the tilted nail in the ejection opening of the nose portion from intersecting with a region located posterior to the guide slope. Thus, even when a nail is discharged while the contact nose is placed at a lower side in a contact-nose knocking mode, the inclination of the nail is regulated by the bottom portion of the nail supply mechanism. Consequently, nails hammered out inclinedly from the nose portion can be surely guided into the ejection opening of the contact nose by the guide slope of the contact nose. Thus, nails can surely be prevented from popping out in the rearward direction of the nose portion.

The invention claimed is:

1. A nailing machine comprising:

a driver driven by an impact mechanism in a housing;

a nose portion including a first ejection opening for slidably guiding the driver, and an aperture through which a foremost one of connected nails is supplied;

a nail supply guide formed continuously to and integrally with a side edge of the aperture;

a nail supply mechanism that is reciprocatively movable along the nail supply guide and supplies the foremost one of connected nails from the aperture into the first ejection opening;

a contact nose, including a second ejection opening opened toward a discharge end of the contact nose, and coaxially formed with the first ejection opening of the nose portion, an upper outer-periphery of the contact nose is slidably provided in a nose holder that is connected to the nose portion, and urged in a direction away from the first ejection opening;

a guide slope, formed obliquely away from discharge end of the second ejection opening of the contact nose, for guiding a tip end of a nail that is discharged from the first ejection opening of the nose portion at a tilt angle askew from the coaxially aligned ejection openings; and an ejection opening end portion provided on a bottom portion of the second ejection opening, wherein an entire circumference is closed by an annular peripheral wall.

2. The nailing machine according to claim 1, wherein a bottom portion of the nail supply mechanism extends toward the discharge end of the contact nose, and wherein the bottom portion regulates the tilt angle of the nail so as to mitigate an axis of the nail supplied into the first ejection opening of the nose portion from being tilted toward the guide slope.

3. The nailing machine according to claim 1, wherein the second ejection opening has an inside diameter substantially equal to an inside diameter of the first ejection opening.

4. The nailing machine according to claim 1, further comprising:

a tapered blowpipe-like portion having an enlarged inside diameter formed at a top portion of the second ejection opening, and configured to guide a head of the nail hammered out from the nose portion into the second ejection opening.

5. The nailing machine according to claim 1, wherein an upper side of the contact nose is accommodated within the nose holder, and an outer circumference of the contact nose and side walls of the contact nose are in contact with an inner circumference of the nose holder.

6. A nailing machine comprising:

a driver driven by an impact mechanism in a housing;

a nose portion including a first ejection opening for slidably guiding the driver, and an aperture through which a foremost one of connected nails is supplied;

a nail supply guide formed continuously to and integrally with a side edge of the aperture;

a nail supply mechanism that is reciprocatively movable along the nail supply guide and supplies the foremost one of connected nails from the aperture into the first ejection opening;

a contact nose including a second ejection opening coaxially formed with the first ejection opening, an upper outer-periphery of the contact nose is slidably provided in a nose holder that is connected to the nose portion, and urged in a direction away from the first ejection opening; and a guide slope, formed obliquely away from discharge end of the second ejection opening, for guiding a tip end of a nail that is discharged from the first ejection opening at a tilt angle askew from the coaxially aligned ejection openings, wherein the second ejection opening has an inside diameter substantially equal to an inside diameter of the first ejection opening.

7. The nailing machine according to claim 6, further comprising:

a tapered blowpipe-like portion having an enlarged inside diameter formed at a top portion of the second ejection opening, and configured to guide a head of the nail hammered out from the nose portion into the second ejection opening.

8. The nailing machine according to claim 6, further comprising:

an ejection opening end portion provided on a bottom portion of the second ejection opening, wherein an entire circumference is closed by an annular peripheral wall.

9. The nailing machine according to claim 6, wherein an upper side of the contact nose is accommodated within the nose holder, and an outer circumference of the contact nose and side walls of the contact nose are in contact with an inner circumference of the nose holder.

* * * * *